US007779764B2

(12) United States Patent
Naidu et al.

(10) Patent No.: US 7,779,764 B2
(45) Date of Patent: Aug. 24, 2010

(54) DURABLE PALLET AND PALLET BLOCK

(75) Inventors: Vishnu Naidu, Windermere, FL (US); James Beerensson, Orlando, FL (US)

(73) Assignee: Chep Technology Pty Limited, Sydney (AU)

( * ) Notice: Subject to any disclaimer, the term of this patent is extended or adjusted under 35 U.S.C. 154(b) by 0 days.

(21) Appl. No.: 11/382,148

(22) Filed: May 8, 2006

(65) Prior Publication Data

US 2007/0256609 A1 Nov. 8, 2007

(51) Int. Cl.
*B65D 19/38* (2006.01)

(52) U.S. Cl. ..... 108/57.26; 108/56.1; 108/901

(58) Field of Classification Search ..... 108/57.25, 108/57.26, 56.1, 56.3, 901
See application file for complete search history.

(56) References Cited

U.S. PATENT DOCUMENTS

| | | | | | |
|---|---|---|---|---|---|
| 3,307,504 | A * | 3/1967 | Cloyd et al. | ..... | 108/56.1 |
| 3,664,271 | A * | 5/1972 | Wolder et al. | ..... | 108/57.26 |
| 4,316,419 | A * | 2/1982 | Cupido | ..... | 108/56.1 |
| 5,094,175 | A | 3/1992 | Christie | | |
| 5,343,814 | A | 9/1994 | Pigott et al. | | |
| 5,413,052 | A * | 5/1995 | Breezer et al. | ..... | 108/56.1 |
| 5,483,899 | A | 1/1996 | Christie | | |
| 5,579,686 | A | 12/1996 | Pigott et al. | | |
| 5,582,113 | A * | 12/1996 | Langenbeck | ..... | 108/57.26 |
| 5,860,369 | A * | 1/1999 | John et al. | ..... | 108/57.26 |
| 6,006,677 | A * | 12/1999 | Apps et al. | ..... | 108/57.25 |
| 6,109,190 | A * | 8/2000 | Hale et al. | ..... | 108/57.25 |
| 6,199,488 | B1 * | 3/2001 | Favaron et al. | ..... | 108/57.25 |
| 6,234,087 | B1 * | 5/2001 | Brown | ..... | 108/56.1 |
| 6,446,563 | B1 * | 9/2002 | Ohanesian | ..... | 108/57.25 |
| 6,886,475 | B2 | 5/2005 | Apps et al. | | |
| 6,892,651 | B1 * | 5/2005 | Van Reed et al. | ..... | 108/56.1 |
| 7,165,499 | B2 | 1/2007 | Apps et al. | ..... | 108/57.25 |
| 7,197,989 | B2 | 4/2007 | Apps | ..... | 108/57.25 |
| 7,293,509 | B2 | 11/2007 | Hassell | ..... | 108/56.3 |
| 7,343,865 | B2 | 3/2008 | Shuert | ..... | 108/57.25 |
| 2004/0069190 | A1 * | 4/2004 | Smyers | ..... | 108/56.1 |
| 2007/0056483 | A1 | 3/2007 | Garcia | ..... | 108/57.25 |
| 2007/0062420 | A1 | 3/2007 | Apps et al. | ..... | 108/57.25 |
| 2007/0131148 | A1 | 6/2007 | Wu | ..... | 108/57.25 |
| 2007/0186826 | A1 | 8/2007 | Kuo | ..... | 108/56.3 |
| 2007/0204769 | A1 | 9/2007 | Wong et al. | ..... | 108/57.25 |
| 2007/0234933 | A1 | 10/2007 | Donnell, Jr. et al. | ..... | 108/56.3 |
| 2007/0277706 | A1 | 12/2007 | Carter et al. | ..... | 108/51.3 |

(Continued)

FOREIGN PATENT DOCUMENTS

| | | | | |
|---|---|---|---|---|
| CH | 605296 | * | 9/1978 | ..... 108/56.3 |

(Continued)

*Primary Examiner*—Hanh V Tran
(74) *Attorney, Agent, or Firm*—Allen, Dyer, Doppelt, Milbrath & Gilchrist, P.A.

(57) ABSTRACT

A pallet includes an upper deck, and first joining members that project downwardly from the upper deck. Each first joining member includes an outer sleeve and a post positioned therein. The pallet includes a lower deck, and second joining members that project upwardly from the lower deck. Each second joining member includes an inner sleeve and a post receiving cavity positioned therein. The first and second joining members are coupled together to define pallet blocks joining the upper and lower decks. Each inner sleeve and post receiving cavity of the second joining members receives a corresponding post and outer sleeve of the first joining members.

31 Claims, 9 Drawing Sheets

U.S. PATENT DOCUMENTS

2008/0017081 A1 1/2008 Baltz ..... 108/56.1
2008/0035033 A1 2/2008 Liebel ..... 108/56.1
2008/0053342 A1 3/2008 Muirhead ..... 108/57.25
2008/0066657 A1 3/2008 Kuo ..... 108/57.19
2008/0105168 A1 5/2008 Lee ..... 108/56.1
2008/0127865 A1 6/2008 Tung-Cheng ..... 108/56.3

FOREIGN PATENT DOCUMENTS

JP 03226455 * 10/1991 ..... 108/56.1

* cited by examiner

DURABLE PALLET AND PALLET BLOCK

FIELD OF THE INVENTION

The invention relates to plastic pallets that are used to support goods and other articles. More particularly, the invention relates to multi-piece plastic pallets that are configured to receive a lifting device.

BACKGROUND OF THE INVENTION

Pallets are flat transport structures that are made of wood, plastic and/or metal. Pallets are used to stably support a variety of goods that are placed on a top surface of the pallet. Pallets enable goods to be stored and/or transported using lifting devices, such as forklifts or other jacking devices.

Wood and metal pallets have many drawbacks. For example, wood pallets suffer from problems including splintering, weight fluctuations due to varying moisture content, and/or lack of hygiene due to mold and/or fungi that result from the moisture, among other problems. Metal pallets suffer from problems including high cost of manufacture, corrosion and/or bending, among other problems. While plastic pallets offer several advantages over wood and metal pallets, a need remains to increase durability and strength of plastic pallets.

SUMMARY OF THE INVENTION

Various aspects of the invention overcome at least some of these and other drawbacks of existing systems. According to one embodiment of the invention, a pallet is provided that includes two or more sections that are joined together. The pallet may include a plurality of pallet blocks that are provided to join a bottom deck and a top deck of the pallet. For example, the pallet may include a plurality of pallet blocks that are located at corners, at locations along a perimeter of the pallet between the corners, at a center of the pallet, or at other locations. The pallet blocks may include rounded corners to provide several benefits, including reduced damage during impact with lifting device prongs, fork tines, or other objects, improved aesthetic appearance and/or other benefits. According to one embodiment of the invention, the pallet blocks may be arranged to provide the pallet with four-way symmetry.

According to another embodiment of the invention, the top deck may include pallet blocks that project downwardly. The pallet blocks on the top deck may include outer sleeves and bosses or posts, among other components.

According to one embodiment of the invention, the bottom deck may include pallet blocks that project upwardly. The pallet blocks on the bottom deck may include inner sleeves, post receiving cavities and radial ribs, among other components. According to another embodiment of the invention, the post receiving cavities may be coupled to the inner sleeves by the plurality of radial ribs. The radial ribs provide many benefits, including increasing the strength and durability of pallet blocks, among other benefits.

According to one embodiment, the post may be inserted into the post receiving cavity and may protrude through an end of the post receiving cavity proximate to the bottom deck. For example, the post may extend beyond a plane that is defined by bottom portions of radial ribs that are located at a far end of the post receiving cavity proximate to the bottom deck. According to one embodiment, during insertion of the post into the post receiving cavity, the outer sleeve is fitted over the inner sleeve. According to another embodiment of the invention, the assembled pallet block includes a two layer block wall thickness formed by the outer sleeve and the inner sleeve. According to another embodiment of the invention, the radial ribs are configured to couple the inner sleeve to the post, thereby increasing the strength of the assembled pallet block by providing impact transmission, among other benefits.

According to another embodiment of the invention, the top deck and the bottom deck may be joined together using a heat staking assembly process that includes using heat and pressure to reform a tip portion of the post. According to one embodiment of the invention, after the post is inserted into the post receiving cavity to protrude through the post receiving cavity and to extend beyond a plane defined by bottom portions of the radial ribs, which are proximate to the bottom deck, the post may be heated and pressed to create a deformed post that mechanically locks the top deck and the bottom deck through the pallet blocks. According to another embodiment of the invention, the post and post receiving cavity may be mechanically fastened using other fastening mechanisms.

The invention provides numerous advantages over and avoids many drawbacks of prior systems. These and other objects, features, and advantages of the invention will be apparent through the detailed description of the embodiments and the drawings attached hereto. It is also to be understood that both the foregoing general description and the following detailed description are exemplary and not restrictive of the scope of the invention. Numerous other objects, features, and advantages of the invention should become apparent upon a reading of the following detailed description when taken in conjunction with the accompanying drawings, a brief description of which is included below.

BRIEF DESCRIPTION OF THE DRAWINGS

The drawings appended hereto are intended to illustrate contemplated embodiments of the invention. The drawings are not intended to limit the invention solely to the embodiments illustrated and described.

DETAILED DESCRIPTION OF THE INVENTION

Figure 1:
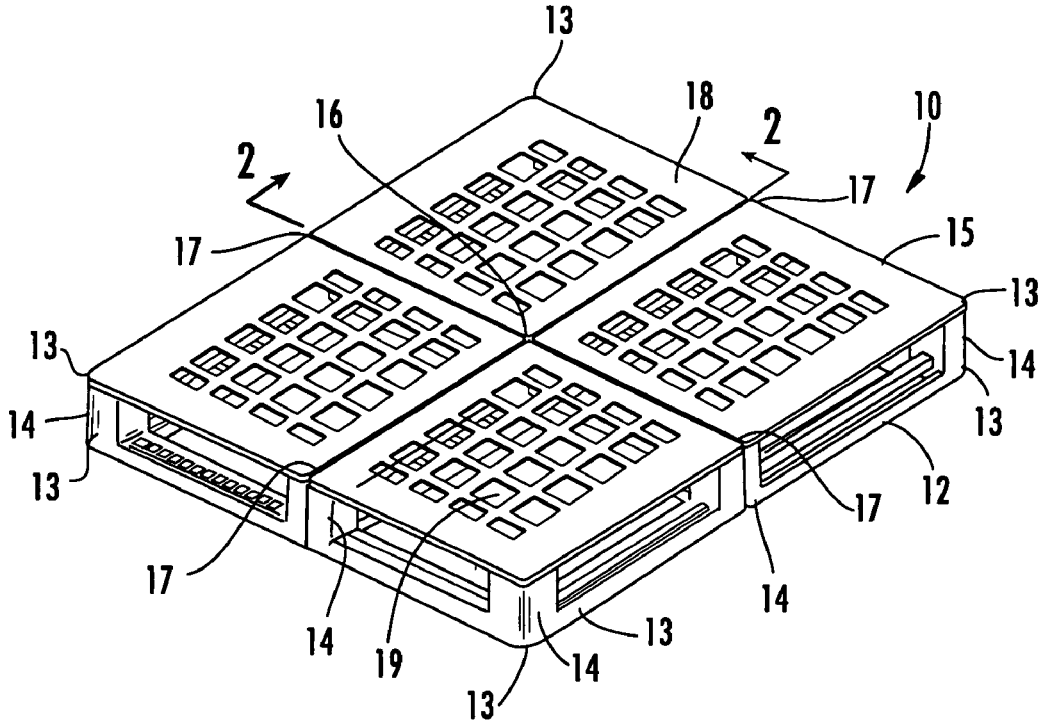
FIG. 1 illustrates a top perspective view of an assembled pallet according to one embodiment of the invention.

FIG. 1 illustrates a pallet 10 according to one embodiment of the invention, having two sections that are joined together. According to one embodiment, pallet 10 may include a lower section, or bottom deck 12, and an upper section, or top deck 15 that are separately molded. Top deck 15 may include a generally flat, planar surface 18 having a plurality of holes 19, wherein holes 19 provide several benefits including reduced surface area of top deck 15, increased breathability for materials placed on top deck 15, reduced weight of top deck 15 and/or other benefits. According to one embodiment of the invention, an outer 100 mm perimeter of planar surface 18 may contain no holes. Bottom deck 12 may include a perimeter shape that substantially matches the perimeter shape of top deck 15. Bottom deck 12 may include a rectangular perimeter shape having cross members that intersect a center portion of each side of the rectangular perimeter, midway between corners 13.

According to one embodiment of the invention, bottom deck 12 and top deck 15 may be molded from thermoplastic or other polymer materials, including high density polyethylene (HDPE), polypropylene (PP), among other polymer materials. As may be appreciated by one of ordinary skill in the art, the polymer materials may be filled or unfilled and/or may include particulate or fibrous, natural or synthetic materials, among other features. For example, unfilled HDPE may provide improved impact strength, PP having strengtheners (i.e., long glass fibers) may provide improved structural properties and unfilled PP with random copolymers may provide improved reinforcement qualities. According to an alternative embodiment of the invention, all or less than all of bottom deck 12 and top deck 15 may be constructed from other materials including wood, metal, or other materials.

According to one embodiment of the invention, bottom deck 12 and top deck 15 may be molded from different thermoplastics or polymer materials. For example, bottom deck 12 may be molded from a first type of thermoplastic or polymer material, while top deck 15 may be molded from a second type of thermoplastic or polymer material. According to another embodiment of the invention, bottom deck 12 may be created from wood, metal or other materials, while top deck 15 may be molded from a second type of thermoplastic or polymer material.

As illustrated from the top perspective in FIG. 1, pallet 10 may be designed to include a substantially square-shape perimeter, among other perimeter shapes. According to one embodiment of the invention, bottom deck 12 and top deck 15 may include rounded corners 13 and/or rounded edges along the perimeter of pallet 10. Rounded corners 13 and/or rounded edges may provide several benefits, including reduced damage during impact with objects, improved aesthetic appearance and/or other benefits.

According to one embodiment of the invention, pallet 10 may include a plurality of pallet blocks 14 that are provided to join bottom deck 12 and top deck 15. For example, pallet 10 may include nine pallet blocks 14 that are located at corners 13, at locations 17 along a perimeter of pallet 10 between corners 13, and at a center 16 of pallet 10. One of ordinary skill in the art will readily appreciate that a greater number or fewer number of pallet blocks 14 may be provided. Pallet blocks 14 may include rounded corners to provide several benefits, including reduced damage during impact with lifting device tines or other objects, improved aesthetic appearance and/or other benefits. According to one embodiment of the invention, pallet blocks 14 may be configured to provide pallet 10 with four-way symmetry. FIGS. 2-20 take advantage of the four-way symmetry by illustrating one quarter of pallet 10 taken along portion 2-2 of FIG. 1.

While specific embodiments of the invention are discussed herein and are illustrated in the drawings appended hereto, the invention encompasses a broader spectrum than the specific subject matter described and illustrated. As would be appreciated by those skilled in the art, the embodiments described herein provide but a few examples of the broad scope of the invention. There is no intention to limit the scope of the invention only to the embodiments described herein.

Figure 2:
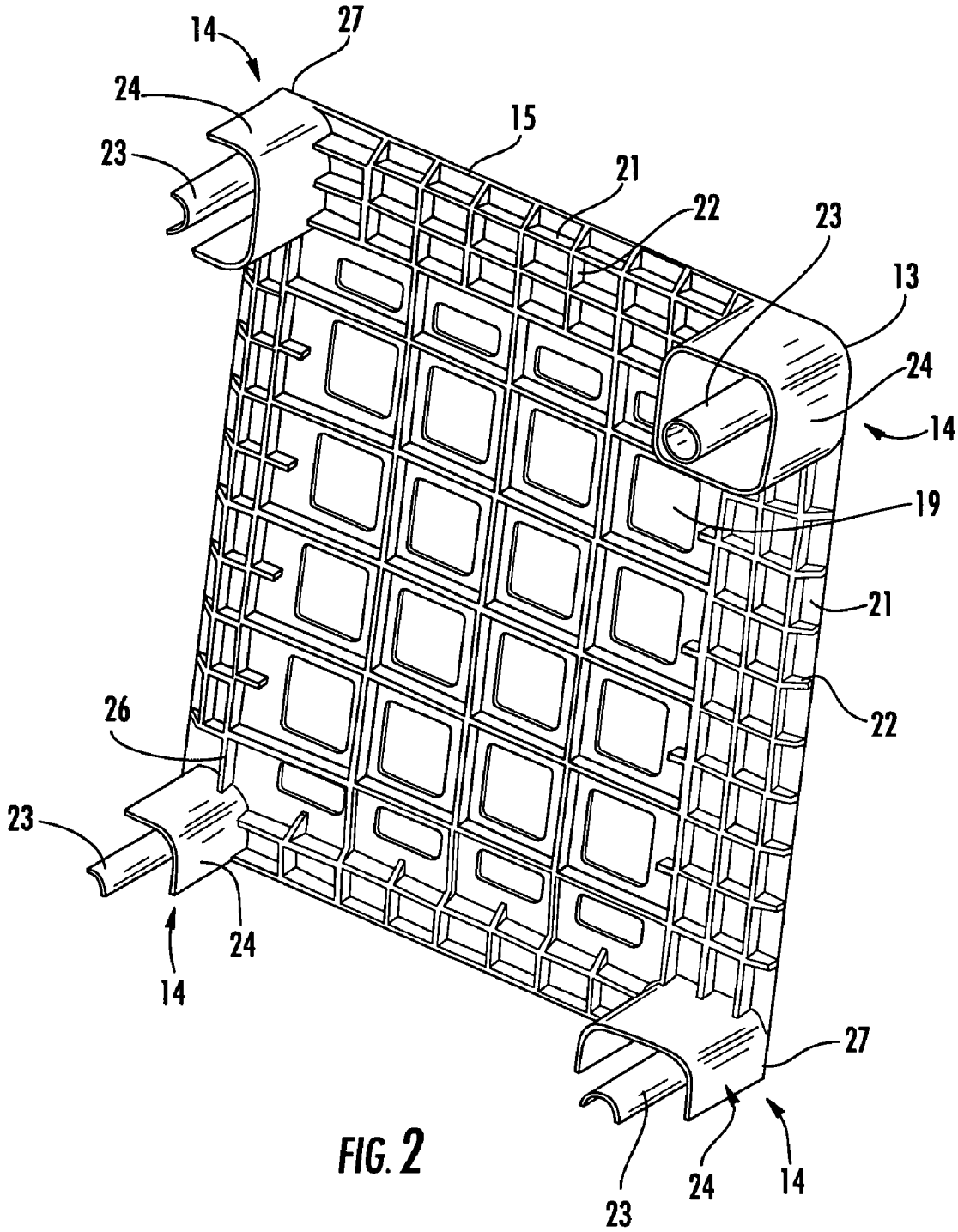
FIG. 2 illustrates a bottom perspective view of the top deck of FIG. 1 according to one embodiment of the invention.
Figure 3:
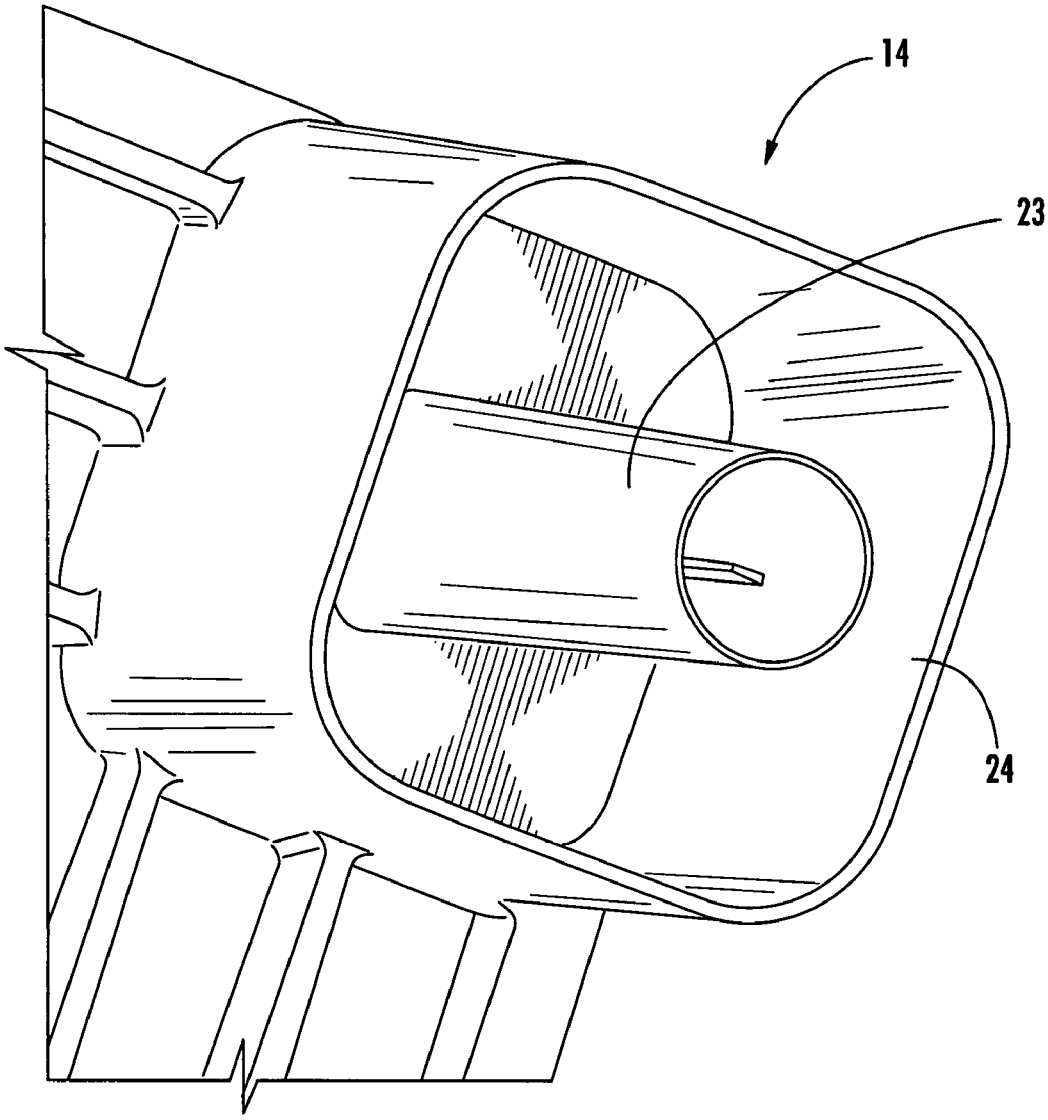
FIG. 3 illustrates an exploded view of a portion of the pallet block corresponding to the top deck according to one embodiment of the invention.

FIG. 2 illustrates a bottom perspective of top deck 15 according to one embodiment of the invention. According to one embodiment of the invention, a series of ribs 21, 22 may be formed on an underside of top deck 15, wherein ribs 21,22 may be arranged parallel 21 and perpendicular 22 to corresponding sides of top deck 15. According to another embodiment of the invention, ribs may be provided that form other angles relative to corresponding sides of top deck 15. As will be readily appreciated by one of ordinary skill in the art, ribs 21, 22 collectively provide increased strength to planar surface 18. According to one embodiment of the invention, pallet blocks 14 may project downwardly from top deck 15 at corners 13, at locations 27 between corners 13, and at a center 26 of top deck 15. One of ordinary skill in the art will readily appreciate that pallet blocks 14 may be positioned at other locations on top deck 15. Pallet blocks 14 may include outer sleeves 24 and bosses or posts 23, among other components. According to one embodiment of the invention, posts 23 may be tapered with a wider portion located proximate to top deck 15. According to another embodiment of the invention, posts 23 may include a uniform diameter throughout their length. Other configurations may be used. According to yet another embodiment of the invention, the perimeter of posts 23 may be any shape, including square-shaped, triangular-shaped, oval-shaped, cross-shaped or any other shape. According to yet another embodiment of the invention, post 23 may be hollow, partially hollow or filled. FIG. 3 illustrates an exploded view of a portion of pallet block 14 corresponding to top deck 15, which includes outer sleeve 24 and post 23. According to one embodiment of the invention, the components of top deck 15, including outer sleeves 24, ribs 21, 22, posts 23 and/or other components, may be made from unfilled HDPE to provide superior impact properties, among other benefits.

Figure 4:
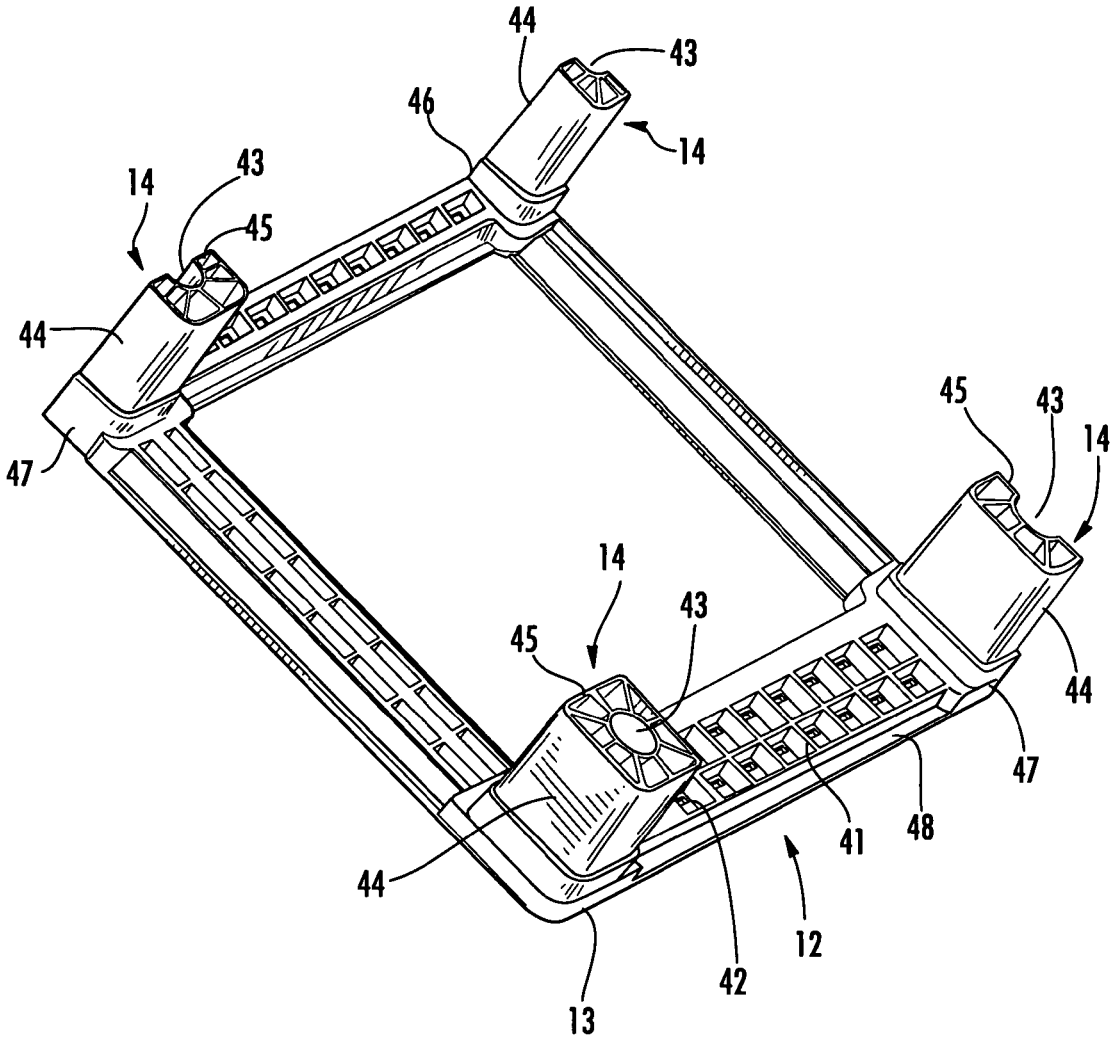
FIG. 4 illustrates a top perspective view of the bottom deck of FIG. 1 according to one embodiment of the invention.
Figure 5:
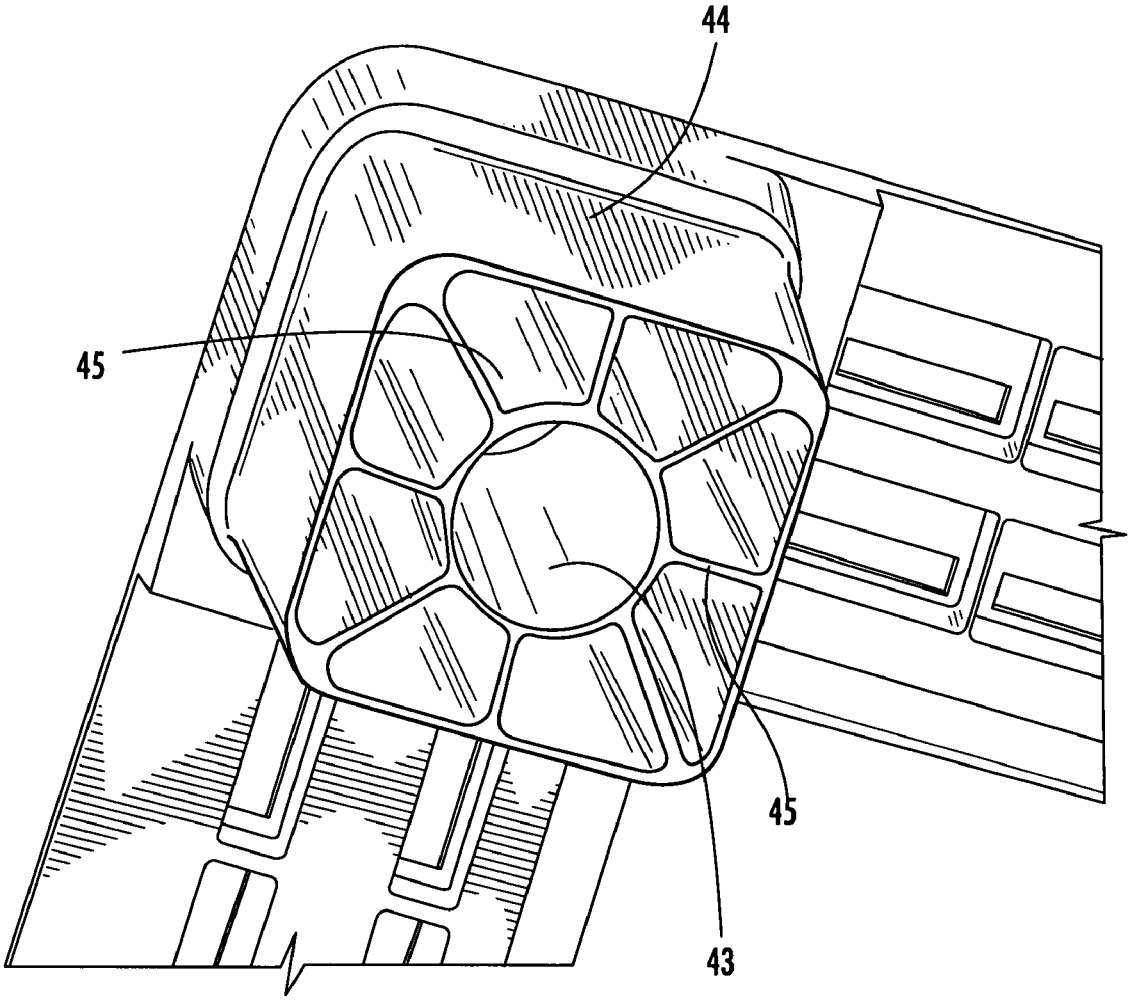
FIG. 5 illustrates an exploded view of a portion of the pallet block corresponding to the bottom deck according to one embodiment of the invention.

FIG. 4 illustrates a top perspective of bottom deck 12 according to one embodiment of the invention. According to one embodiment, a series of ribs 41 may be formed on an upper side of bottom deck 12, wherein ribs 41 may be arranged parallel and/or perpendicular to corresponding sides of bottom deck 12. According to another embodiment of the invention, ribs may be provided that form other angles relative to corresponding sides of bottom deck 12. As readily appreciated by one of ordinary skill in the art, ribs 41 collectively provide increased strength to substantially planar surface 42, while also enabling bottom deck 12 to benefit from lighter weight. According to one embodiment of the invention, planar surface 42 may include beveled edges 48. According to another embodiment of the invention, pallet blocks 14 may project upwardly from bottom deck 12 at corners 13, at locations 47 between corners 13, and at a center 46 of bottom deck 12. One of ordinary skill in the art will readily appreciate that pallet blocks 14 may be positioned at other locations on bottom deck 12. Pallet blocks 14 may include inner sleeves 44, post receiving cavities 43 and radial ribs 45, among other components. According to one embodiment of the invention, post receiving cavities 43 may be tapered with a narrow portion located proximate to bottom deck 12. According to another embodiment of the invention, post receiving cavities 43 may include a uniform diameter throughout their length. Other configurations may be used. According to yet another embodiment of the invention, the perimeter of post receiving cavities 43 may be any shape, including square-shaped, triangular-shaped, oval-shaped, cross-shaped, or any other shape. According to yet another embodiment of the invention, post receiving cavities 43 may be coupled to inner sleeves 44 by a plurality of radial ribs 45 that extend along a length of post receiving cavity 43. According to another embodiment of the invention, radial ribs 45 may extend in a direction parallel to the planar surface 42. Other radial rib configurations will be appreciated by those skilled in the art and are intended to be encompassed by the invention. Radial ribs 45 provide many benefits, including increasing the strength and durability of pallet blocks 14, among other benefits. FIG. 5 illustrates an exploded view of a portion of the pallet block 14 that corresponds to bottom deck 12, including post receiving cavity 43, inner sleeve 44 and radial ribs 45, according to one embodiment of the invention. According to another embodiment of the invention, the components of bottom deck 12, including inner sleeves 44, radial ribs 45, ribs 41, post receiving cavities 43 and/or other components, may be made from PP with long glass fibers, unfilled PP random copolymer or other materials.

Figure 6:
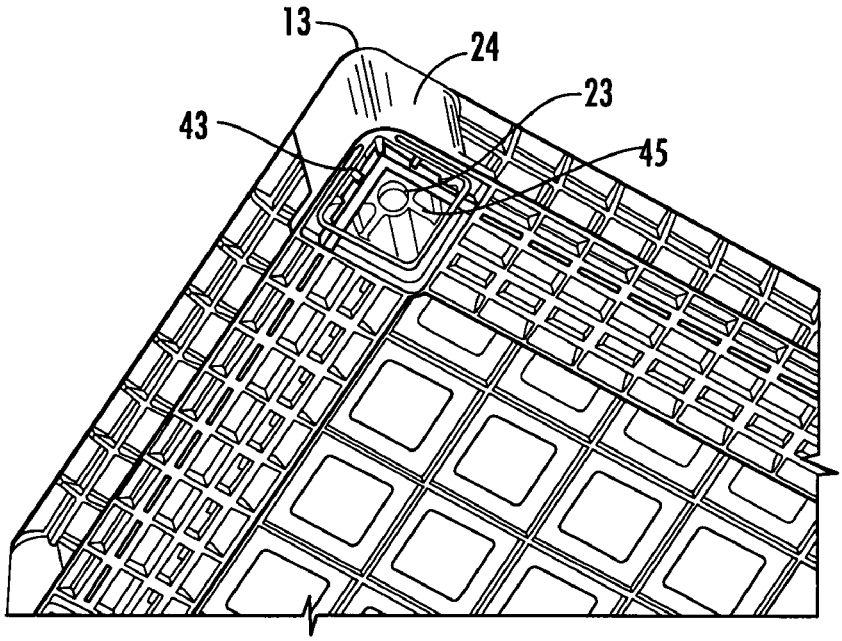
FIG. 6 illustrates a bottom perspective view of an assembled pallet and pallet block according to one embodiment of the invention.
Figure 7:
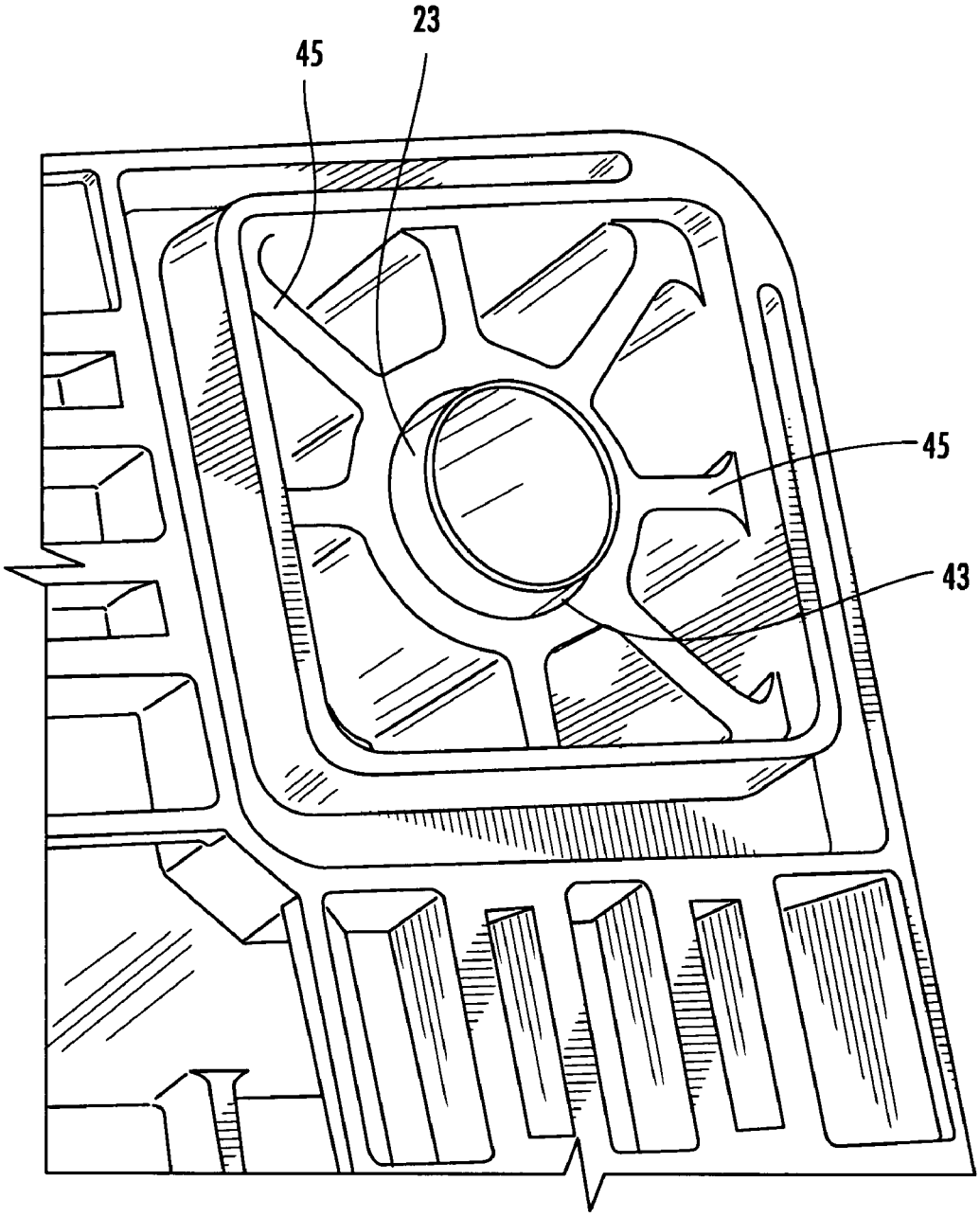
FIG. 7 illustrates an exploded view of the bottom perspective of an assembled pallet block according to one embodiment of the invention.

FIG. 6 illustrates a bottom perspective view of an assembled pallet block 14 according to one embodiment of the invention. According to one embodiment, post 23 may be inserted into post receiving cavity 43 to protrude through post receiving cavity 43 and to extend beyond a plane that is defined by bottom portions of radial ribs 45 proximate to bottom deck 12. During insertion of post 23 into post receiving cavity 43, outer sleeve 24 is fitted over inner sleeve 44. FIG. 7 illustrates an exploded view of the bottom perspective of assembled pallet block 14. According to one embodiment of the invention, assembled pallet block 14 includes a two layer block wall thickness formed by fitting outer sleeve 24 over inner sleeve 44, thereby increasing the strength of assembled pallet block 14. According to another embodiment of the invention, radial ribs 45 may be configured to couple inner sleeve 44 and post 23 in order to increase the strength of assembled pallet block 14 by providing impact transmission, among other benefits.

Figure 8:
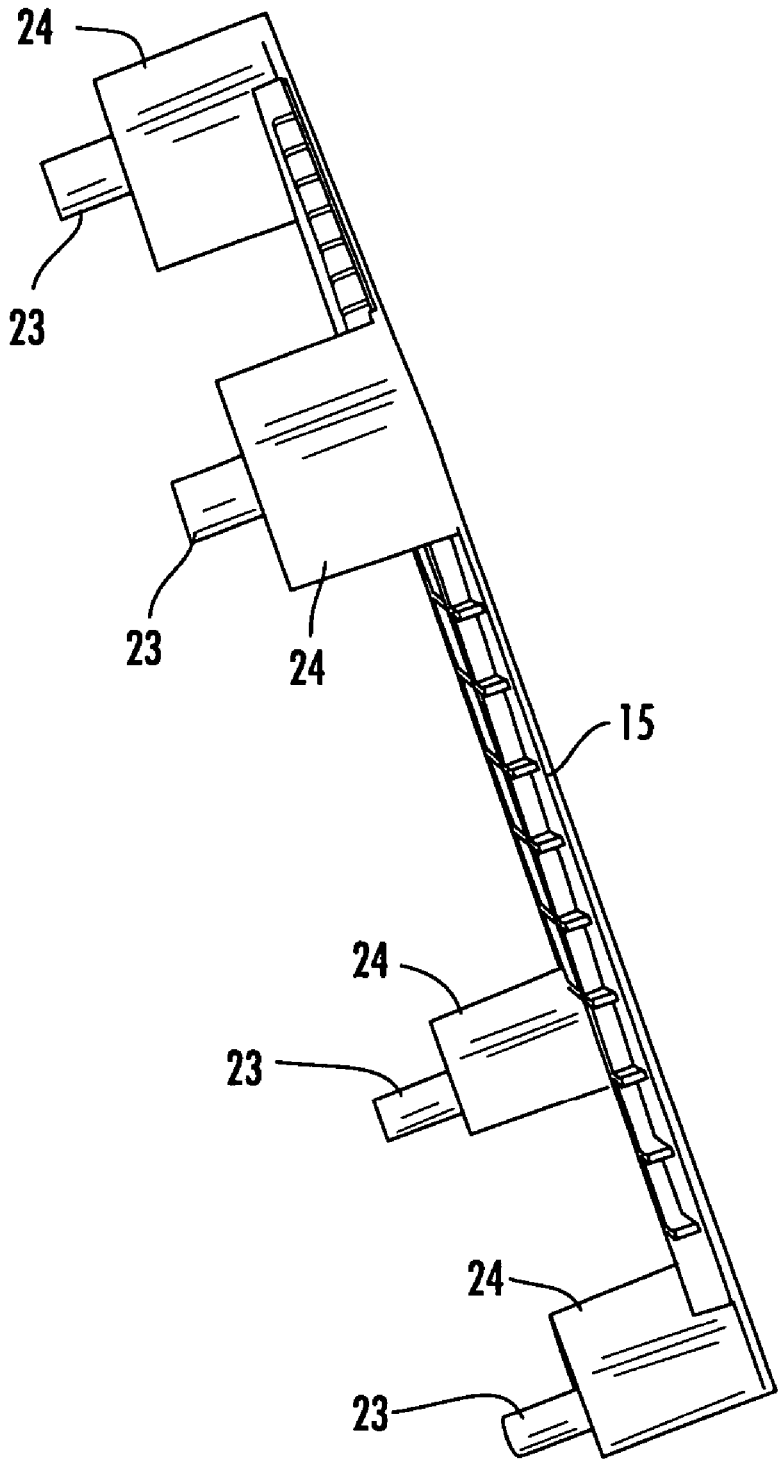
FIG. 8 illustrates a side view of the top deck illustrated in FIG. 2 according to one embodiment of the invention.
Figure 9:
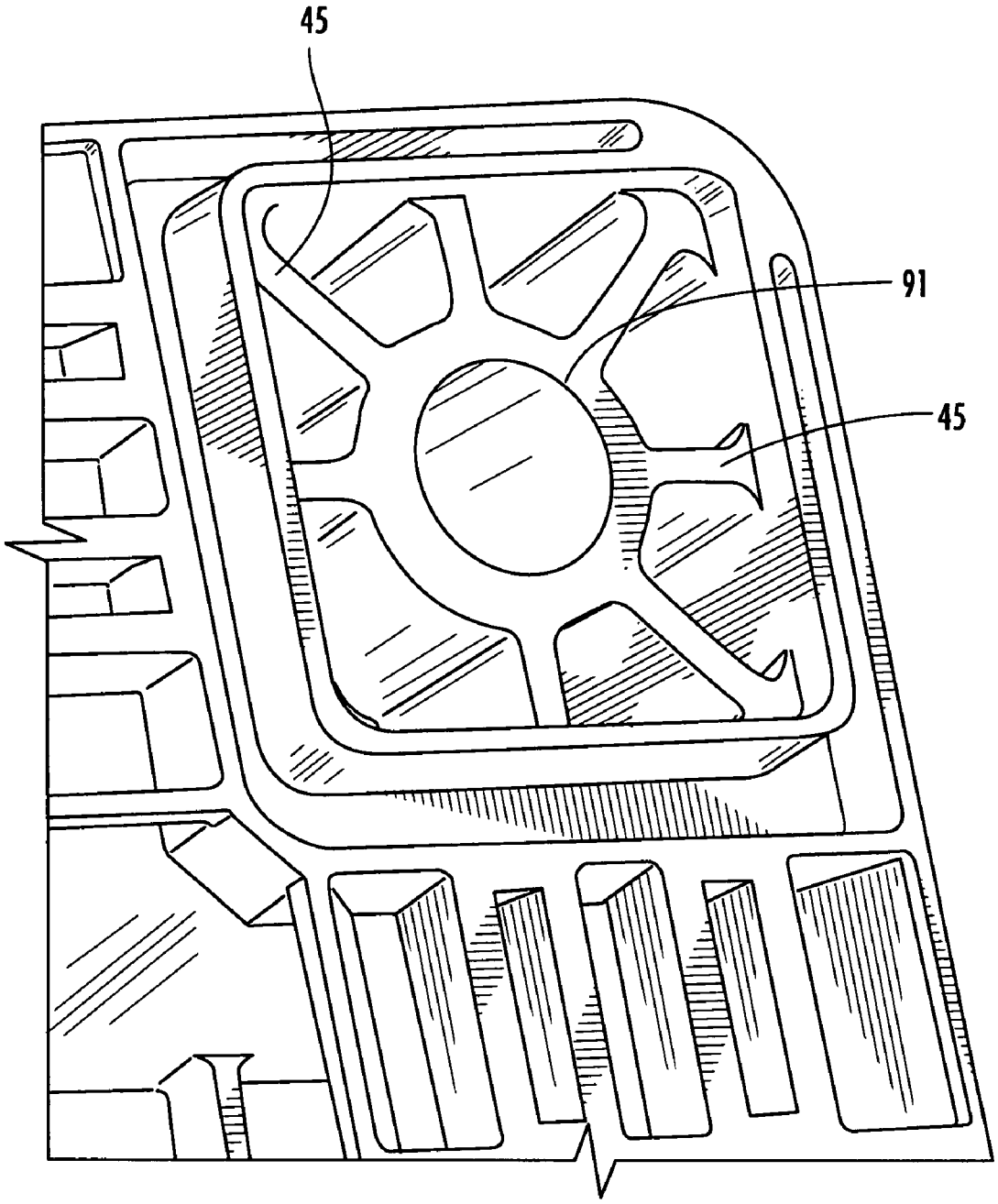
FIG. 9 illustrates an exploded view of the bottom perspective of an assembled pallet block having a deformed post according to one embodiment of the invention.

According to another embodiment of the invention, top deck 15 and bottom deck 12 may be joined together using a heat staking assembly process that includes providing heat and pressure to reform a tip portion of post 23. The heat staking process typically includes providing sufficient heat to a thermoplastic component to reset the thermoplastic components' memory, but not to melt the thermoplastic component. FIG. 8 illustrates a side view of top deck 15 having post 23 protruding beyond outer sleeve 24. According to one embodiment of the invention, the height of post 23 may be selected to be at least 1.5 times the largest diameter of post 23. According to one embodiment of the invention illustrated in FIG. 9, after post 23 is inserted into post receiving cavity 43 to protrude through post receiving cavity 43 and extend beyond a plane defined by bottom portions of radial ribs 45, post 23 may be heated and pressed to create deformed post 91 that mechanically locks top deck 15 and bottom deck 12 through pallet blocks 14. According to another embodiment of the invention, a compression probe or other deforming tool may be used to create deformed post 91.

According to yet another embodiment of the invention, post 23 and post receiving cavity 43 may be fastened together with a snapping mechanism. According to one embodiment, a tip portion of post 23 may include a tab that rides past a lower end of post receiving cavity 43 proximate to bottom deck 12. When the tab clears the lower end of post receiving cavity 43, the tab may bend outwardly to mechanically lock top deck 15 and bottom deck 12. According to another embodiment of the invention, the tab may be located on any portion of post 23 to engage post receiving cavity 43 or other components. According to an alternative embodiment of the invention, the tab may be located on the post receiving cavity 43 to engage post 23 or other component. Other fastening mechanisms will be appreciated by those skilled in the art and are intended to be encompassed by the invention.

Figure 11:
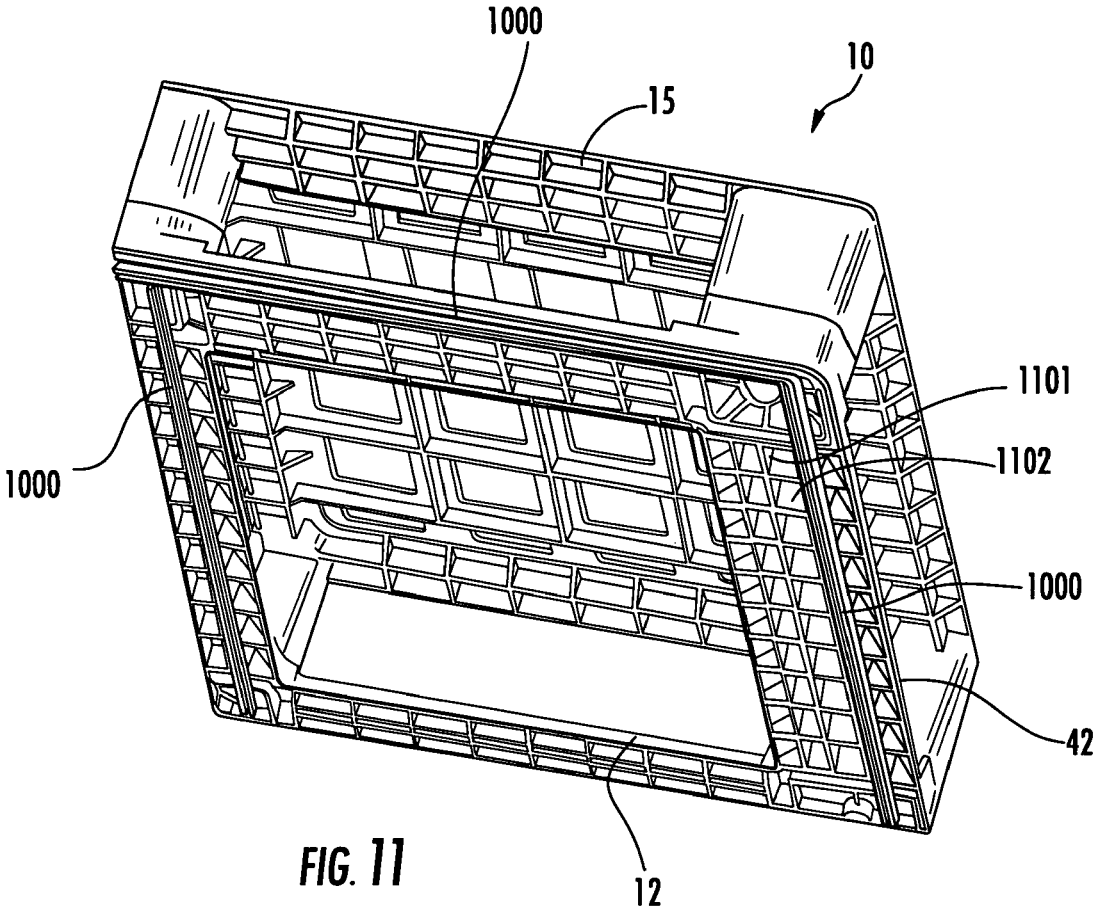
FIG. 11 illustrates a bottom perspective view of an assembled pallet that includes reinforcing rods according to one embodiment of the invention.
Figure 10:
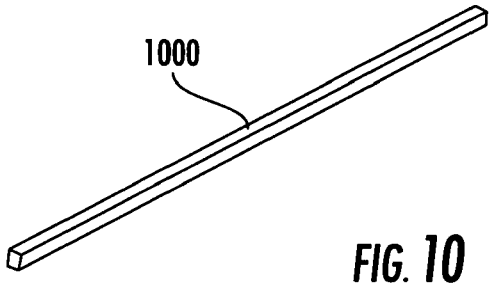
FIG. 10 illustrates a reinforcing rod according to one embodiment of the invention.

FIG. 10 illustrates a reinforcing rod 1000 according to one embodiment of the invention. FIG. 11 illustrates a bottom perspective view of an assembled pallet 10, according to one embodiment of the invention, that includes a plurality of reinforcing rods 1000 inserted into bottom deck 12. In FIG. 11, top deck 15 is illustrated in a lighter shade than bottom deck 12. According to one embodiment of the invention, a series of ribs 1101,1102 may be formed on an underside of bottom deck 12, wherein the ribs 1101,1102 may be arranged parallel 1101 and perpendicular 1102 to corresponding sides of top deck 12. According to another embodiment of the invention, ribs may be provided that form other angles relative to corresponding sides of top deck 12. As readily appreciated by one of ordinary skill in the art, ribs 1101, 1102 collectively provide increased strength to planar surface 42. According to another embodiment of the invention, ribs 1101, 1102 may be configured to provide cavities for receiving reinforcing rods 1000 therein.

While the preferred forms of the invention have been disclosed, it will be apparent to those skilled in the art that various changes and modifications may be made that will achieve some of the advantages of the invention without departing from the spirit and scope of the invention. For example, the system may be configured to replace the pallet block portion of the top deck with the pallet block portion of the bottom deck and vice versa. It will be apparent to those reasonably skilled in the art that other components performing the same function may be suitably substituted. Therefore, the scope of the invention is to be determined solely by the appended claims.

We claim:

1. A pallet comprising:

an upper deck having a rectangular perimeter shape;

a plurality of first joining members that project downwardly from the upper deck, each first joining member integrally molded with said upper deck and including an outer sleeve and a post positioned therein, with the post protruding beyond the outer sleeve;

a lower deck having a rectangular perimeter shape comprising a plurality of rectangular perimeter shape sections, each section comprising integrally molded members, said sections joined together to define said lower deck, the lower deck having integrally molded cross members that intersect a center portion of opposing sides of the rectangular perimeter shape midway between corners thereof;

a plurality of second joining members that project upwardly from the lower deck, each second joining member integrally molded with the cross members of said lower deck and including an inner sleeve and a post receiving cavity positioned therein; and the plurality of first and second joining members being coupled together to define a plurality of pallet blocks joining the upper and lower decks, with each inner sleeve and post receiving cavity of the second joining members receiving a corresponding post and outer sleeve of the first joining members, with each post receiving cavity receiving the post protruding beyond the outer sleeve.

2. The pallet according to claim 1, wherein the upper deck includes a planar surface having a plurality of openings extending therethrough.

3. The pallet according to claim 1, wherein the upper deck includes a first perimeter shape and the lower deck includes a perimeter shape that substantially matches the first perimeter shape.

4. The pallet according to claim 1, wherein the upper deck and the lower deck are separately molded from at least one of thermoplastic and polymer materials.

5. The pallet according to claim 1, wherein the upper deck and the lower deck comprise different materials.

6. The pallet according to claim 1, wherein the upper deck and the lower deck include at least one of rounded corners and rounded edges.

7. The pallet according to claim 1, wherein the plurality of first joining members and the plurality of second joining members are positioned at matching locations on the corresponding upper deck and lower deck, wherein the locations include corners of the corresponding upper deck and lower deck, a perimeter of the corresponding upper deck and lower deck, and a center of the corresponding upper deck and lower deck.

8. The pallet according to claim 7, wherein the upper deck includes nine of the first joining members and the lower deck includes nine of the second joining members.

9. The pallet according to claim 1, wherein each post of the plurality of first joining members includes a perimeter shape having at least one of a square-shape, a triangular-shape, an oval-shape, and a cross-shape.

10. The pallet according to claim 9, wherein each post receiving cavity of the plurality of second joining members includes a same perimeter shape as each corresponding post of the plurality of first joining members.

11. The pallet according to claim 1, wherein each of the outer and inner sleeves has rounded corners.

12. The pallet according to claim 1, wherein, when fully inserted, a tip portion of each post extends beyond an outer exposed bottom end portion of each corresponding post receiving cavity.

13. The pallet according to claim 1, wherein each post is tapered with a wider portion located proximate to the upper deck.

14. The pallet according to claim 1, further comprising one or more reinforcing rods inserted into at least one of the lower deck and the upper deck.

15. A pallet comprising:

an upper deck having a rectangular perimeter shape;

a plurality of first joining members that project downwardly from the upper deck, each first joining member integrally molded with said upper deck and including an outer sleeve and a post positioned therein, with the post protruding beyond the outer sleeve;

a lower deck having a rectangular perimeter shape comprising a plurality of rectangular perimeter shape sections, each section comprising integrally molded members, said sections joined together to define said lower deck, the lower deck having integrally molded cross members that intersect a center portion of opposing sides of the rectangular perimeter shape midway between corners thereof;

a plurality of second joining members that project upwardly from the lower deck, each second joining member integrally molded with the cross members of said lower deck and including an inner sleeve and a post receiving cavity positioned therein, and radial ribs extending between the inner sleeve and the post receiving cavity; and the plurality of first and second joining members being coupled together to define a plurality of pallet blocks joining the upper and lower decks, with each inner sleeve and post receiving cavity of the second joining members receiving a corresponding post and outer sleeve of the first joining members, with each post receiving cavity receiving the post protruding beyond the outer sleeve.

16. The pallet according to claim 15, wherein the upper deck includes a planar surface having a plurality of openings extending therethrough.

17. The pallet according to claim 15, wherein the upper deck includes a first perimeter shape and the lower deck includes a perimeter shape that substantially matches the first perimeter shape.

18. The pallet according to claim 15, wherein the upper deck and the lower deck are separately molded from at least one of thermoplastic and polymer materials.

19. The pallet according to claim 15, wherein the upper deck and the lower deck comprise different materials.

20. The pallet according to claim 15, wherein the upper deck and the lower deck include at least one of rounded corners and rounded edges.

21. The pallet according to claim 15, wherein the plurality of first joining members and the plurality of second joining members are positioned at matching locations on the corresponding upper deck and lower deck, wherein the locations include corners of the corresponding upper deck and lower deck, a perimeter of the corresponding upper deck and lower deck, and a center of the corresponding upper deck and lower deck.

22. The pallet according to claim 21, wherein the upper deck includes nine of the first joining members and the lower deck includes nine of the second joining members.

23. The pallet according to claim 15, wherein each post of the plurality of first joining members includes a perimeter shape having at least one of a square-shape, a triangular-shape, an oval-shape, and a cross-shape.

24. The pallet according to claim 23, wherein each post receiving cavity of the plurality of second joining members includes a same perimeter shape as each corresponding post of the plurality of first joining members.

25. The pallet according to claim 15, wherein each of the outer and inner sleeves has rounded corners.

26. The pallet according to claim 15, wherein, when fully inserted, a tip portion of each post extends beyond an outer exposed bottom end portion of each corresponding post receiving cavity.

27. The pallet according to claim 15, wherein each post is tapered with a wider portion located proximate to the upper deck.

28. The pallet according to claim 15, further comprising one or more reinforcing rods inserted into at least one of the lower deck and the upper deck.

29. The pallet according to claim 15, wherein the radial ribs extend along a length of the inner sleeve and along a length of the post receiving cavity.

30. The pallet according to claim 29, wherein the radial ribs are arranged substantially perpendicular to a plane defined by the planar surface of the upper deck or a planar surface of the lower deck.

31. A method of making a pallet comprising:

providing an upper deck having a rectangular perimeter shape and a plurality of first joining members that project downwardly from the upper deck, each first joining member integrally molded with the upper deck and including an outer sleeve and a post positioned therein, with the post protruding beyond the outer sleeve;

providing a lower deck having a rectangular perimeter Shape, the lower deck comprising a plurality of rectangular perimeter shape sections, each section comprising integrally molded members, said sections joined together to define said lower deck, the lower deck having integrally molded cross members that intersect a center portion of opposing sides of the rectangular perimeter shape midway between corners thereof, and a plurality of second joining members that project upwardly from the lower deck, each second joining member integrally molded with the cross members of the lower deck and including an inner sleeve and a post receiving cavity positioned therein; and joining the upper and lower decks by coupling the plurality of first and second joining members together to define a plurality of pallet blocks, with each inner sleeve and post receiving cavity of the second joining members receiving a corresponding post and outer sleeve of the first joining members, with each post receiving cavity receiving the post protruding beyond the outer sleeve.

* * * * *